United States Patent [19]

Coltharp

[11] 4,334,474

[45] Jun. 15, 1982

[54] WARHEAD INITIATION SYSTEM

[75] Inventor: David R. Coltharp, Vicksburg, Miss.

[73] Assignee: The United States of America as represented by the Secretary of the Navy, Washington, D.C.

[21] Appl. No.: 690,208

[22] Filed: May 21, 1976

[51] Int. Cl.[3] ..... F42C 11/00

[52] U.S. Cl. ..... 102/206; 102/202.5; 102/202.7

[58] Field of Search ..... 102/28, 28 EB, 56, 70.2, 102/70.2 A, DIG. 2, 206, 202.5, 202.7, 701, 473; 89/8

[56] References Cited

U.S. PATENT DOCUMENTS

| | | | |
|---|---|---|---|
| 3,245,353 | 4/1966 | Gilbertson et al. | 102/70.2 A |
| 3,344,744 | 10/1967 | Bankston, Jr. | 102/28 EB |
| 3,447,416 | 6/1969 | Apstein | 102/28 M |
| 3,457,859 | 7/1969 | Guenther | 102/28 EB |
| 3,985,078 | 10/1976 | Hart et al. | 89/8 X |

FOREIGN PATENT DOCUMENTS

| | | | |
|---|---|---|---|
| 357005 | 9/1961 | Switzerland | 102/DIG. 2 |

*Primary Examiner*—Charles T. Jordan

*Attorney, Agent, or Firm*—R. S. Sciascia; A. L. Branning

[57] ABSTRACT

A warhead initiation system in which a helical magnetic fluxtrapper explodes a copper mesh initiator at a single point, several points, along a line and/or over a surface.

4 Claims, 7 Drawing Figures

NEW WARHEAD INITIATION SYSTEM

BACKGROUND OF THE INVENTION

Present warhead concepts utilize single or multiple detonators which initiate the explosive at a point. Actually, the detonators initiate the explosive over a surface, but the surface area is so small in relation to the dimensions of the warhead that it is considered a point.

The warhead designer, working with point detonators, is limited in his choice of initiation schemes due to the physical size of the detonator. To initiate a warhead along any of several lines parallel to the axis and surface of the explosive charge requires relinquishing space that is normally used for fragments and using it for the detonators. Likewise, plane wave initiation cannot be incorporated in a device due to the large number of detonators needed. There do exist means for producing line or plane detonation waves which use only one detonator and a train of explosive, but these, however, are used for experimental studies and are too bulky for use in a warhead.

SUMMARY OF THE INVENTION

The warhead initiator system uses a helical fluxtrapper to explode a copper foil initiator which is embedded in a warhead. A helical fluxtrapper is a hollow metal rod filled with explosive and surrounded by a coil of wire. The coil of wire creates a magnetic field when current flows through it. Upon detonating the explosive the hollow rod expands and shorts out the coil, the energy stored in the magnetic field is converted to energy in the form of current.

The copper foil initiator is chemically etched to form many exploding bridgewire detonators. The foil is coated with a secondary explosive such as PETN and when current from the fluxtrapper is passed through the foil, the bridgewires explode and detonate the explosive simultaneously.

The entire system is small enough for inclusion in the ordnance section of a missile and allows for the warhead to be initiated by the foil at either a single point, several points, along a line or over a surface depending upon the foil geometry.

STATEMENT OF THE OBJECTS OF THE INVENTION

An object of the invention is to provide for simultaneous initiation at several points, along a line, or over a surface.

An object of the invention is that the initiator can be cast into the main explosive charge of a warhead.

Another object of the invention is that the initiator uses a negligible amount of volume so that neither fragments nor explosive need be sacrificed.

Other objects, advantages and novel features of the invention will become apparent from the following detailed description of the invention when considered in conjunction with the accompanying drawings.

DESCRIPTION OF THE PREFERRED EMBODIMENT

Figure 1:
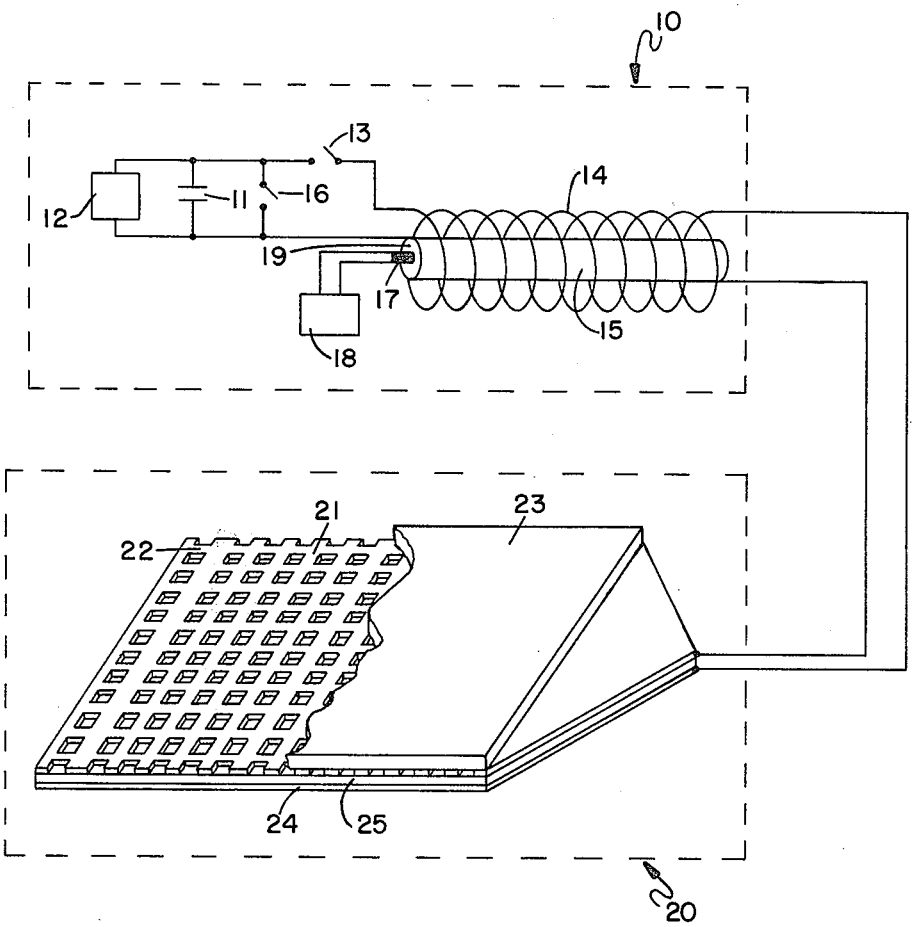
FIG. 1 is a schematic of the warhead initiation system.

The schematic of the warhead initiation system is shown in FIG. 1. A helical magnetic fluxtrapper power supply 10 is connected to an electrically exploded copper mesh initiator 20. The capacitor 11 is charged up by a small power supply 12. Switch 13 is closed allowing current from the capacitor 11 to flow through the helical coil 14 of the fluxtrapper, the copper mesh initiator 20 and the cylindrical armature 15. Switch 16 is then closed to take the capacitor 11 out of the circuit and simultaneously the detonator 17 is fired using power supply 18. The explosive 19 inside the armature detonates and causes the armature 15 to expand and short out the coils 14 of the helix from left to right. As the helical coils 14 are shorted out the inductance of the circuit is lowered and the current through the initiator 20 increases.

The copper mesh initiator 20 has a thin copper foil 21 which is chemically etched to form many small exploding bridgewires 22. The foil is coated with a secondary explosive 23. The initiator 20 is available, for example, from Sandia Corporation. When the current flowing from the fluxtrapper 10 through the initiator 20 reaches a critical value, the many bridgewires 22 explode simultaneously detonating the explosive 23. The bridgewires are separated from the return transmission line 24 by an insulating material 25.

The overall size of the copper mesh initiator can be varied to suit a particular application. Also the thickness of the foil 21 and the length, width and number of bridgewires 22 can be changed. Any of these changes must be accompanied by modification of the fluxtrapper 10 so that enough current will be delivered to the initiator 20.

FIG. 2 shows one use of the initiator system. In this configuration the initiator is used to control the fragment mass and shape of the warhead casing 30 upon detonation and subsequent breakup of the case. This is done by selecting the fragment mass and shape desired and designing the mesh pattern of the initiator so that upon detonation the detonation waves from each of the mesh points will collide along predetermined lines. This collision produces localized regions of high pressure and when the lines of collision reach the case wall they will cause the case to fracture along similar lines both in the longitudinal and transverse direction resulting in the fragment mass and shape desired.

Figure 2A:
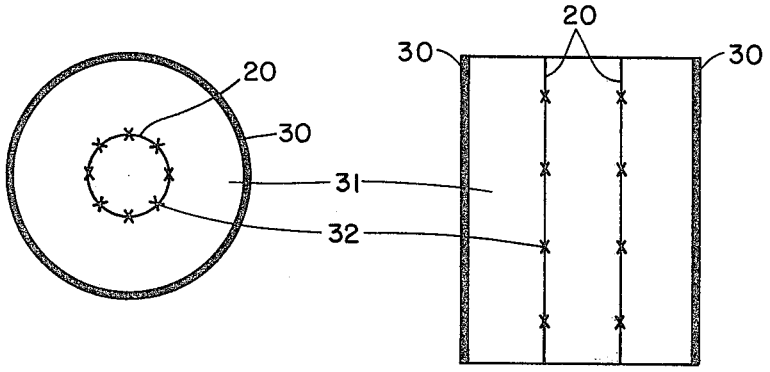
FIG. 2A–C is a timing sequence of detonation and breakup of the warhead case in top and side views.
Figure 2B:
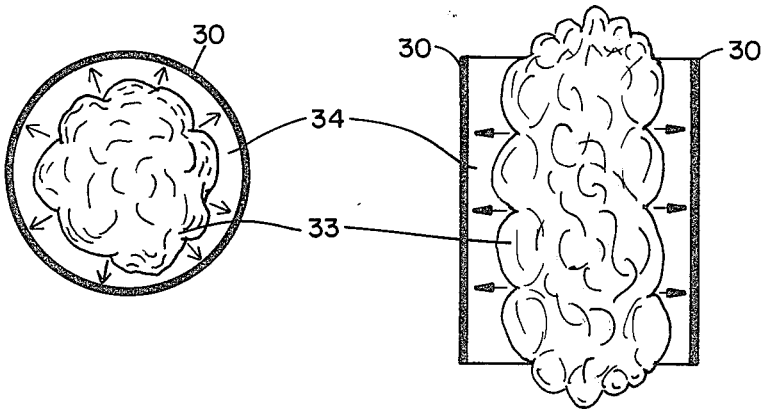
Figure 2C:
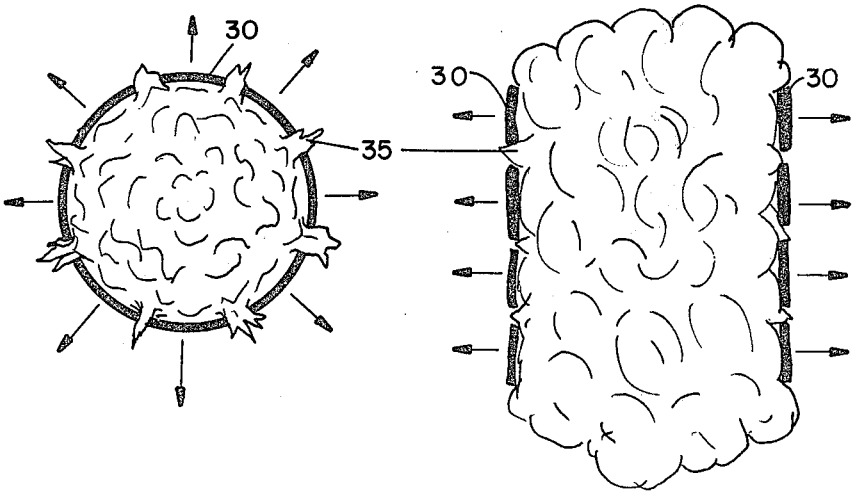

FIG. 2A shows the warhead prior to detonation. The initiator 20 is embedded in explosive 31. The warhead is detonated at the initiation points 32. FIG. 2B shows the warhead during detonation. The detonation products 33 expand into the collision zone of detonation waves 34. FIG. 2C shows the case 30 fracture with the breakthrough of the collision zone 35.

Figure 3:
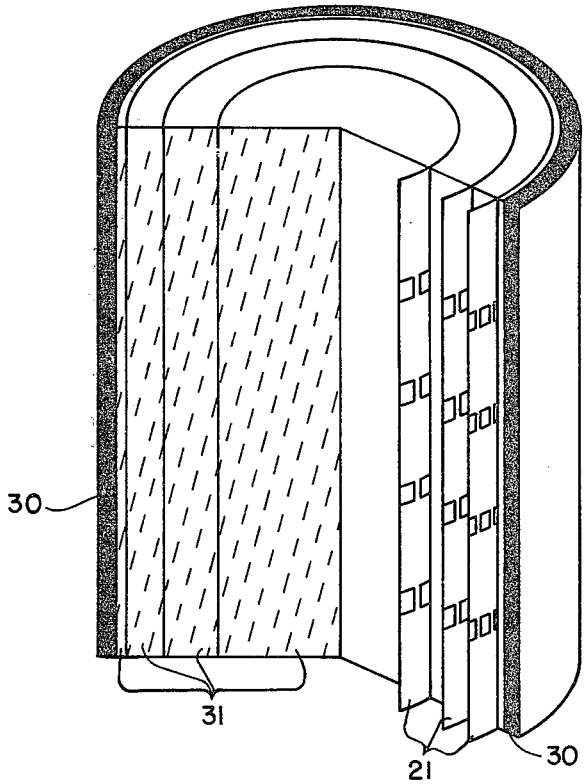
FIG. 3 is a sectional view of concentric initiator.

The initiator 20 can be made thin enough so that it can be formed into a cylindrical or conical shape. It can also be placed in and surrounded by the main high explosive charge 31 of a warhead. In FIG. 3, any one of the several foil concentric cylinders 21 within a warhead can be initiated. The number and spacing of the bridgewires for each cylinder is chosen so that colliding detonation waves are formed upon detonation and fracture the warhead casing 30 into predetermined fragment sizes depending upon which cylinder is initiated.

Utilizing this concept, one warhead can be used for different targets.

Figure 4:
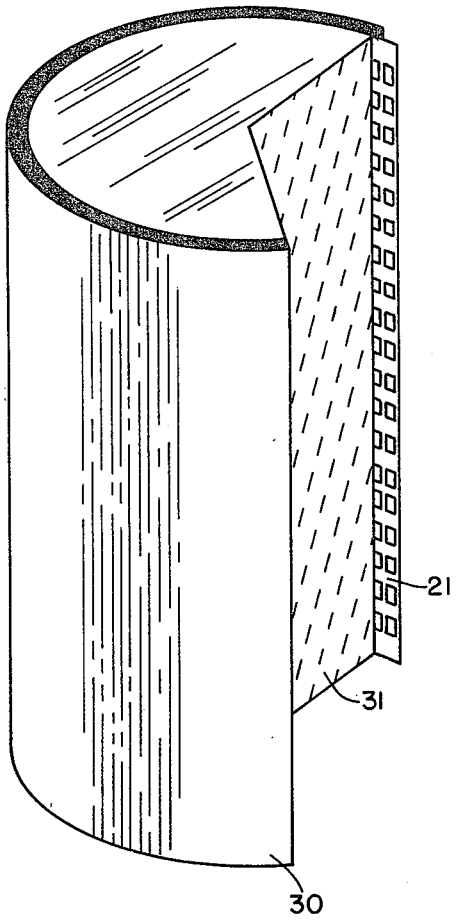
FIG. 4 is a sectional view of a line initiator.

FIG. 4 illustrates initiation along any chosen line along the periphery of the warhead. This offers an aiming capability to the warhead. Any line or lines of initiation can be chosen to direct the fragments toward the target.

Figure 5:
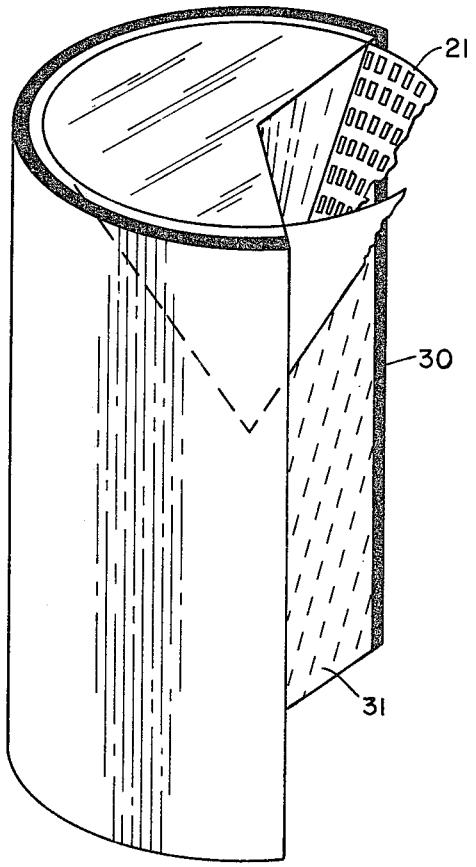
FIG. 5 is a sectional view of a conical surface initiator.

FIG. 5 illustrates the initiation of a conical surface within the warhead to give a "shape charge" effect.

Obviously many modifications and variations of the present invention are possible in the light of the above teachings. It is therefore to be understood that within the scope of the appended claims the invention may be practiced otherwise than as specifically described.

What is claimed is:

1. A warhead initiation system comprising:

an explosive filled warhead casing;

a copper mesh initiator embedded within said explosive filled casing formed of a chemically etched copper foil wherein there are formed bridgewires and a secondary explosive which coats said foil and is detonated thereby; and a helical magnetic fluxtrapper power supply electrically connected to said copper mesh initiator for exploding said copper mesh initiator and thereby detonating the explosive within the warhead casing; said helical magnetic fluxtrapper power supply comprising:

a capacitor;

a first power supply for charging said capacitor;

a magnetic fluxtrapper including:

a detonator;

an explosive;

a hollow metal rod filled with said explosive and containing said detonator and said rod is connected to said copper mesh initiator; and a coil of wire surrounding said rod and connected to said copper mesh initiator;

a first switch connected between said capacitor and said coil, which when closed, allows current from said capacitor to flow through said coil, said copper mesh initiator and said metal rod;

a second switch, which when closed, shorts out said capacitor; and a second power supply which fires said fluxtrapper detonator at the time said second switch is closed, whereupon the fluxtrapper explosive is detonated and said hollow rod expands to short out said coil.

2. The device of claim 1 wherein said copper foil is several concentric cylinders.

3. The device of claim 1 wherein said copper foil is along the periphery of said warhead casing.

4. The device of claim 1 wherein said copper foil is a cone.

* * * * *